United States Patent [19]

Buckley

[11] Patent Number: 4,718,144

[45] Date of Patent: Jan. 12, 1988

[54] FRICTION SUPPORTED STAYS FOR WINDOWS

[75] Inventor: John E. Buckley, Tewkesbury, England

[73] Assignee: Securistyle Limited, Nottingham, England

[21] Appl. No.: 780,227

[22] Filed: Sep. 24, 1985

Related U.S. Application Data

[63] Continuation of Ser. No. 560,560, Dec. 12, 1983, abandoned.

[30] Foreign Application Priority Data

Dec. 24, 1982 [GB] United Kingdom ..... 8236777

[51] Int. Cl.[4] ..... E05C 17/04

[52] U.S. Cl. ..... 16/341; 16/363; 49/252

[58] Field of Search ..... 16/337, 341, 342, 363, 16/371, 374, 368–370, 272; 49/246, 248, 250–252, 260

[56] References Cited

U.S. PATENT DOCUMENTS

| | | | |
|---|---|---|---|
| 1,855,698 | 4/1932 | Taylor | 49/248 |
| 2,416,511 | 2/1947 | Blanck | 49/260 |
| 2,784,459 | 3/1957 | Anderberg et al. | 49/250 |
| 2,950,509 | 8/1960 | Stavenau | 16/337 |
| 3,122,799 | 3/1964 | Lunde | 49/252 |
| 3,345,777 | 10/1967 | Anderberg et al. | 49/250 |
| 3,828,395 | 8/1974 | Grady | 16/342 |
| 4,226,002 | 10/1980 | Davis | 16/363 |
| 4,364,201 | 12/1982 | Taylor | 49/251 |

FOREIGN PATENT DOCUMENTS

| | | | |
|---|---|---|---|
| 896552 | 5/1962 | United Kingdom | 49/252 |
| 2047309 | 11/1980 | United Kingdom | 49/251 |

*Primary Examiner*—E. R. Kazenske
*Assistant Examiner*—James L. Wolfe
*Attorney, Agent, or Firm*—Jerry W. Mills; Gregory M. Howison

[57] ABSTRACT

A friction supporting stay comprises a channel section track (10) and a slider (15) linked to a strut (24). At the upper and of track (10) is a cap (14) with internal surfaces (36) (37) engageable by one end of strut (24). A plastic nose member (35) is riveted to the end of strut (24) and is formed with surfaces (39) (40) shaped to engage the corresponding surfaces (36) (37).

9 Claims, 2 Drawing Figures

FRICTION SUPPORTED STAYS FOR WINDOWS

This application is a continuation of Ser. No. 560,560, filed Dec. 12, 1983, now abandoned.

TECHNICAL FIELD OF THE INVENTION

The invention relates to friction supporting stays generally and more particularly to a friction supporting stay, of the kind comprising a track, a slider moveable along the track, a strut pivotally connected to the track, a brace pivotally connected between the slider and the strut, a link pivotally connected to the slider, and a bar pivotally connected to the link and to the strut.

The invention relates to friction supporting stays, of the kind comprising a track, a slider moveable along the track, a strut pivotally connected to the track, a brace pivotally connected between the slider and the strut, a link pivotally connected to the slider, and a bar pivotally connected to the link and to the strut, the arrangement being such that as the slider moves along the track the bar can swing from a position overlying the track to a position where it is angled with respect to the track.

BACKGROUND OF THE INVENTION

In use, two such supporting stays are normally provided at opposite sides of a window, the track of each stay being mounted on the window frame and the bar being mounted on the window sash. The arrangement is such that as the window pivots on the stays, about either a vertical or a horizontal axis, the axis of pivoting of the window sash moves away from the window frame so that when the window is open both sides thereof are accessible from one side of the window frame.

The window sash is frictionally restrained in any angular position to which it is set. This frictional restraint may be provided partly by the friction at the pivotal connections between the various elements but is largely provided by the frictional engagement between the slider and the track.

In friction supporting stays of this kind, the end of the track remote from the strut is normally provided with a cap member having one or more internal surfaces engageable by the end of the bar. The cap member may, for example, provide two internal cam surfaces meeting at an apex, and the end of the bar which overlies the track when the stay is in the closed position is provided with a correspondingly shaped nose portion which enters the cap member and engages the cam surfaces with a wedging action as the stay is moved into the closed position.

In friction stays having such cap members, the cap member is conventionally formed from plastics material and is riveted or staked to the metal track. The nose portion, however, normally simply comprises a shaped end portion of the metal bar. A disadvantage of known friction stays of this kind is that with repeated use the hard metal nose portion causes wear of the plastics cap member, so that, in time, the proper wedging action between the two parts does not take place.

SUMMARY OF THE INVENTION

According to the invention the shaped nose portion is formed on a plastics nose member secured to the end of the bar, for example by riveting.

Preferably the nose portion has external surfaces shaped to engage the corresponding internal surfaces in the cap member in the strut.

Preferably these surfaces are set at an angle to each other; and preferably at different angles to the longitudinal axis of the strut and bar respectively.

In these friction stays the strut is usually pivotally connected to the track by means of a rivet, and in the case where the track is channel-sectioned the web of the channel section may be domed upwardly where the rivet passes through it to provide a support for the end of the strut just above the side walls of the channel section. A disadvantage of this arrangement is that the metal of the web of the track is fairly thin and therefore engages only a short length of the shank of the rivet, providing little support against tilting of the rivet. With continued use of the stay, therefore, the metal of the track tends to become worn and/or deformed and the rivet becomes loose leading to inaccuracy in operation of the stay. An optional feature of the present invention therefore provides a mounting arrangement for the strut on the track which overcomes this disadvantage.

According to another feature of the invention, in a friction stay of the kind referred to above, the strut is pivotally mounted on a block which is secured to the track. The block, which may be formed from plastics, may be secured to the track by the same rivet which also pivotally connects the strut to the block. Alternatively or additionally the block may be secured to the track by further securing means.

In the case where the track is in the form of a channel having inturned flanges along the extremities of the side walls thereof, the block may be shaped to be located within the said channel and formed with longitudinal recesses to receive said flanges.

Preferably the block has a surface portion which projects above the surface of the track to provide a bearing surface to prevent components of the stay, particularly the strut and brace, from binding against the track itself. Preferably the block extends along a substantial length of the track beyond the area of the pivot between the strut and the track.

BRIEF DESCRIPTION OF THE DRAWINGS

The following is a detailed description of an embodiment of the invention, by way of example, reference being made to the accompanying drawings in which.

DETAILED DESCRIPTION OF THE INVENTION

Figures 1, 2:
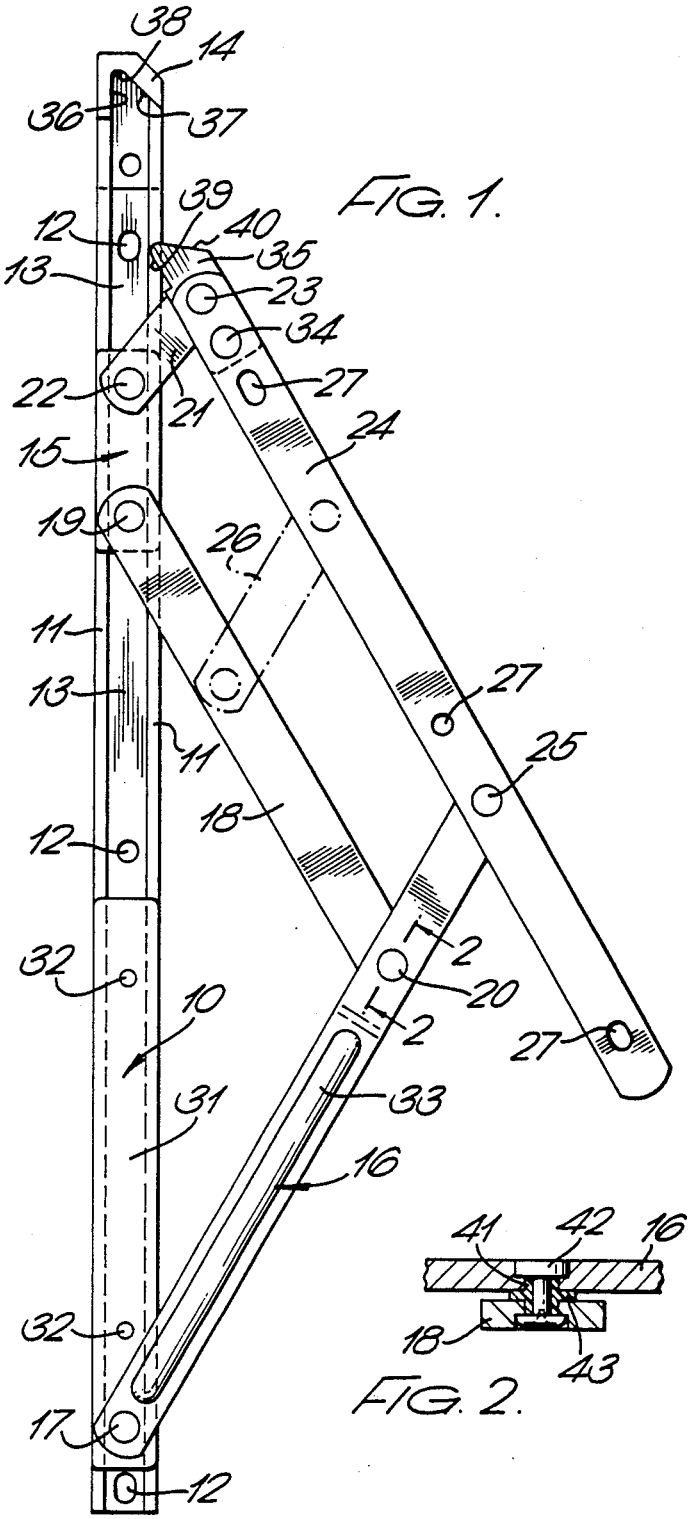
FIG. 1 is a plan view of a supporting stay according to the invention, shown in a partly open position.
FIG. 2 is a section, on an enlarged scale, through one of the pivot joints between two components of the stay.

Referring to FIG. 1, the supporting stay comprises a channel-sectioned track member 10 having longitudinal inturned flanges 11. The track member is, in use of the stay, normally secured vertically to the window frame, two stays being provided at opposite sides respectively of the window frame. Fixing holes 12 are provided in the web 13 of the track member to receive fixing screws. At its upper end the track member is closed by a plastics shaped cap member 14 which is plugged into the end of the track member and may be staked to the track member by deforming a part of the web, or secured by means of a rivet.

A slider 15 is slideable along the track member and is provided with longitudinal grooves to receive the flanges 11 of the track member. Thus the slider must be introduced into the track member before the cap member 14 is fitted.

An elongate cranked metal strut 16 is pivotally connected to the track member 10 by a rivet 17 which passes through an elongate plastics block 31 which is of similar cross-sectional shape to the slider 15 and is received within the channel of the track member, having longitudinal grooves to receive the flanges 11. The rivet 17 may pass through both the block 31 and the web 13 of the track member or it may pass only through the block 31, the block being secured to the track member by other means, for example by means of rivets 32.

An elongate brace 18 is pivotally connected at one end, by a rivet 19, to the slider 15 and at the opposite end thereof, by a rivet 20, to a part of the strut 16 intermediate the ends thereof. The strut 16 has a longitudinal channel 33, of curved cross-section, deformed out of the surface thereof to increase the ridigity of the strut.

A short link 21 is pivotally connected to the slider 15 by a rivet 22 at a location spaced from the rivet 19. The opposite end of the link 21 is pivotally connected by a rivet 23 to one end of a bar 24, which is in turn pivotally connected, intermediate its ends, by a rivet 25 to the extremity of the strut 16. A cross-link 26, shown in chain lines, may be pivotally connected between the brace 18 and the bar 24, parallel to the strut 16, if required.

The bar 24 is, in use, connected to the side member of the window sash frame and fixing holes 27 are provided for this purpose.

In operation, the bar 24 may be swung from the angled position shown in FIG. 1, in which the window is open, to a closed position where the bar 24 overlies the track member 10 and the window is closed. The dimensions of the elements of the stay, and the positions of the rivets, are so chosen that the strut 16, brace 18 and link 21 also overlie the track member 10 when the window is in a closed position.

The upper end of the bar 24 has mounted thereon, by means of the rivet 23 and a further rivet 34, a nose member 35 made of plastics material which cooperates with the cap member 14 as the window is closed.

The cap member 14 is provided with two internal surfaces 36 and 37 which meet at an apex 38 which is displaced to one side of the central longitudinal axis of the track member 10. The surface 36 extends generally parallel to said axis and the surface 37 is inclined so as to intersect the axis. The nose member 35 on the bar 24 is formed with correspondingly shaped surfaces 39 and 40.

As the bar 24 moves to the closed position, the inclined surface 40 on the nose member 35 engages the inclined surface 37 on the cap 14 with a wedging action, bringing the surface 39 into abutting engagement with the surface 36. The surface 39 is formed in a rebate in the nose member 35 to permit the bar 24 to overlie the track. It will be seen that engagement between the surfaces 39 and 36 prevents the stay being opened to the left hand side of the track member 10, as viewed in FIG. 1. The asymmetric arrangement of the nose member 35 and cap member 14 ensures that the nose member enters the angle in the cap member even though the elements of the stay may be deflected due to the weight of a window mounted on the bar 24. As previously explained, in conventional friction stays the nose portion on the upper end of the bar 24 is so shaped that if the elements of the stay become deflected it is possible for the nose portion to strike the outer right hand side of the cap 14 and thus prevent the nose portion entering the cap.

It will be seen that since the slider 15 and block 31 each have portions thereof overlying the flanges 11 of the track member, they serve to prevent the elements of the stay, particularly the link 21, brace 18 and strut 16, from binding against the flanges of the track member, which might otherwise happen due to deflection of the stay elements under the weight of the window.

Any suitable form of pivotal connection may be employed between the elements of the stay, but FIG. 2 shows a preferred arrangement where a plastics bush 41 encircles the shank of the rivet 42 and is provided with an outwardly projecting peripheral flange 43 to separate the two components of the stay. It will be seen that the holes through the stay components are counterbored to receive the head and tail respectively of the rivet. The provision of the plastics bush around the rivet reduces metal-to-metal contact and thus reduces wear of the holes in the stay components which might otherwise lead to loosening of the pivotal connections and inaccurate operation of the stay.

I claim:

1. A friction supporting stay comprising:

a track;

a slider movable along the track;

a strut pivotally connected to the track;

a brace pivotally connected between the slider and the strut;

a link pivotally connected to the slider;

a metal bar pivotally connected to the link and to the strut to extend therebetween, the bar having a separate plastic nose portion secured at the end thereof remote from the strut, said nose portion being of greater thickness than said bar and having one or more external surfaces substantially perpendicular to the plane of said bar, said bar operatively coupled so that as said slider moves along said track said bar swings between a closed position overlying said track to an open position angled with respect to said track; and a plastic cap member being of greater thickness than said bar and disposed on the end of said track remote from said strut, said cap member having one or more internal surfaces engageable by the external surfaces of said nose portion of said bar, the external surfaces of said plastic nose portion shaped to cooperate with the internal surfaces of said plastic cap member to wedge therein with the greater thickness of said nose portion and said cap member providing a more secure and accurate location of said nose portion.

2. The stay of claim 1 wherein the plastic nose portion is formed with external surfaces shaped to engage each of said internal surfaces in the cap member.

3. The stay of claim 2 wherein the the two external surfaces of said plastic nose portion are set at an angle to each other with an apex at the intersection of said two external surfaces.

4. The stay of claim 3 wherein said external surfaces are set at different angles to the longitudinal axis of the bar such that the apex is offset relative to the longitudinal axis of said bar toward the side thereof more proximate said track when said bar is parallel to said track, the offset ensuring that said nose portion enters said cap member even if said track, said strut, said brace, said link or said metal bar may be deflected due to loading thereof.

5. The stay of claim 1 further comprising a block, said block being secured to the track and said strut being pivotally mounted on the block.

6. The stay of claim 5 further comprising a rivet for securing said block to the track and for also pivotably connecting the strut to the block and wherein the block is formed from plastic.

7. The stay of claim 5 wherein the track includes a channel having inturned flanges along the extremities of the side walls of the track, and wherein the block is shaped to be located within the said channel and is formed with longitudinal recesses to receive said flanges.

8. The stay of claim 5 wherein the block has a surface portion which projects above the surface of the track to provide a bearing surface to prevent components of the stay from binding against the track.

9. The stay of claim 5 wherein the block extends along a substantial length of the track beyond the area of the pivot between the strut and the track.

* * * * *